United States Patent [19]

Holder

[11] 4,156,356

[45] May 29, 1979

[54] HOSIERY KNITTING MACHINE SINKER CONTROL

[75] Inventor: Otis W. Holder, Mount Airy, N.C.

[73] Assignee: Oakdale Knitting Company, Mount Airy, N.C.

[21] Appl. No.: 937,262

[22] Filed: Aug. 28, 1978

[51] Int. Cl.[2] ..... D04B 15/06

[52] U.S. Cl. ..... 66/108 R; 66/108 A

[58] Field of Search ..... 66/104, 107, 108 R, 66/108 A, 93, 48, 51, 52, 53

[56] References Cited

U.S. PATENT DOCUMENTS

| | | | |
|---|---|---|---|
| 2,366,124 | 12/1944 | Page | 66/108 R |
| 3,200,618 | 8/1965 | Fregedlle | 66/108 A |
| 3,293,887 | 12/1966 | Crawford | 66/108 R |
| 3,372,562 | 3/1968 | Imboden et al. | 66/108 A |

FOREIGN PATENT DOCUMENTS

| | | | |
|---|---|---|---|
| 518175 | 2/1931 | Fed. Rep. of Germany | 66/108 R |
| 658660 | 12/1963 | Italy | 66/108 R |
| 658662 | 12/1963 | Italy | 66/108 R X |

*Primary Examiner*—Ronald Feldbaum

*Attorney, Agent, or Firm*—Bell, Seltzer, Park & Gibson

[57] ABSTRACT

The present sinker control is operable to control the positioning of terry sinkers in the knitting machine during reciprocatory knitting of heel and toe pockets in socks. The sinker control operates to form terry loops on all but a few needles at opposite ends of the narrowed and widened partial courses of the pockets so that narrow areas adjacent the suture lines are devoid of terry loops. An auxiliary terry sinker control cam (35) is operable for engaging the upstanding nebs of the terry sinkers (T) and moving them inwardly to a partially advanced position and a main terry sinker control cam (45) is engageable with the nebs of the terry sinkers to insert the same earlier than normal to form terry loops. The operation of the main terry sinker control cam is controlled during reciprocation by a needle butt cam (60) and during continuous rotary knitting by cams on a pattern control drum (24).

7 Claims, 4 Drawing Figures

HOSIERY KNITTING MACHINE SINKER CONTROL

FIELD OF THE INVENTION

This invention relates to a sinker control for controlling the position of the terry sinkers during continuous rotary knitting and during reciprocatory knitting of heel and toe pockets in socks.

BACKGROUND OF THE INVENTION

In the formation of terry loops in the knitting of heels and toes for socks it is the common practice to form terry loops on the terry sinkers between all of the active needles during both the narrowing and widening operations so that terry loops are formed along the suture lines connecting the narrowed and widened sections of the heel and toe. It is necessary to maintain a vertical separation of the body yarn and the terry yarn to properly form terry loops and the body yarn has a tendency to also be drawn over the top of the nebs of the first few terry sinkers when starting an oscillation of the machine. When this occurs, the body yarn may be cut or large eyelets may be formed in the suture.

Summary of the Invention

With the foregoing in mind, it is an object of the present invention to provide a terry sinker control whereby both the body and terry yarns are maintained below the nebs of the terry sinkers positioned between the first few and the last few active needles knitting the partial courses forming the heel and toe pockets in socks. This is accomplished by delaying the insertion of the terry sinkers at the beginning of the partial course and withdrawing the terry sinkers just prior to completion of the knitting of the partial course. Under these conditions, no terry loops are formed in narrow areas adjacent the suture lines and the body yarn is maintained in a lower position and is not drawn over the nebs of the terry sinkers.

In accordance with the present invention, an auxiliary terry sinker control cam is pivotally supported on the sinker cap and has a cam surface for engaging the upstanding nebs of the terry sinkers to initially move the terry sinkers inwardly to a partially advanced position between the needles. A main terry sinker control cam is pivotally supported at one end on the sinker cap and includes a cam surface for engaging the upstanding nebs of the terry sinkers to insert the same earlier than normal to form terry loops.

A first control is operated by the butts of the inactive group of needles during reciprocatory knitting so that the position of the main terry sinker control cam accurately advances and withdraws the terry sinkers during each counterclockwise oscillation. A needle butt cam is provided with a steep leading cam surface and a shallow trailing cam surface and controls the position of the main terry sinker control cam so that terry loops are not formed on the first few and the last few active needles during both the narrowing and widening operations in the formation of heel and toe pockets.

A second control is provided for controlling the positioning of the main terry sinker control cam during rotary knitting, such as during the knitting of the cuff and leg portion to selectively form terry loops during selected continuous rotations of the needle cylinder. This second control is operated by cams on the pattern drum and includes linkage connected to the linkage connecting the needle butt cam to the main terry sinker control cam.

BRIEF DESCRIPTION OF THE DRAWINGS

Some of the objects and advantages of the invention having been stated, others will become apparent as the description proceeds, when taken in connection with the accompanying drawings, in which.

DESCRIPTION OF THE ILLUSTRATED EMBODIMENT

Figures 1, 2:
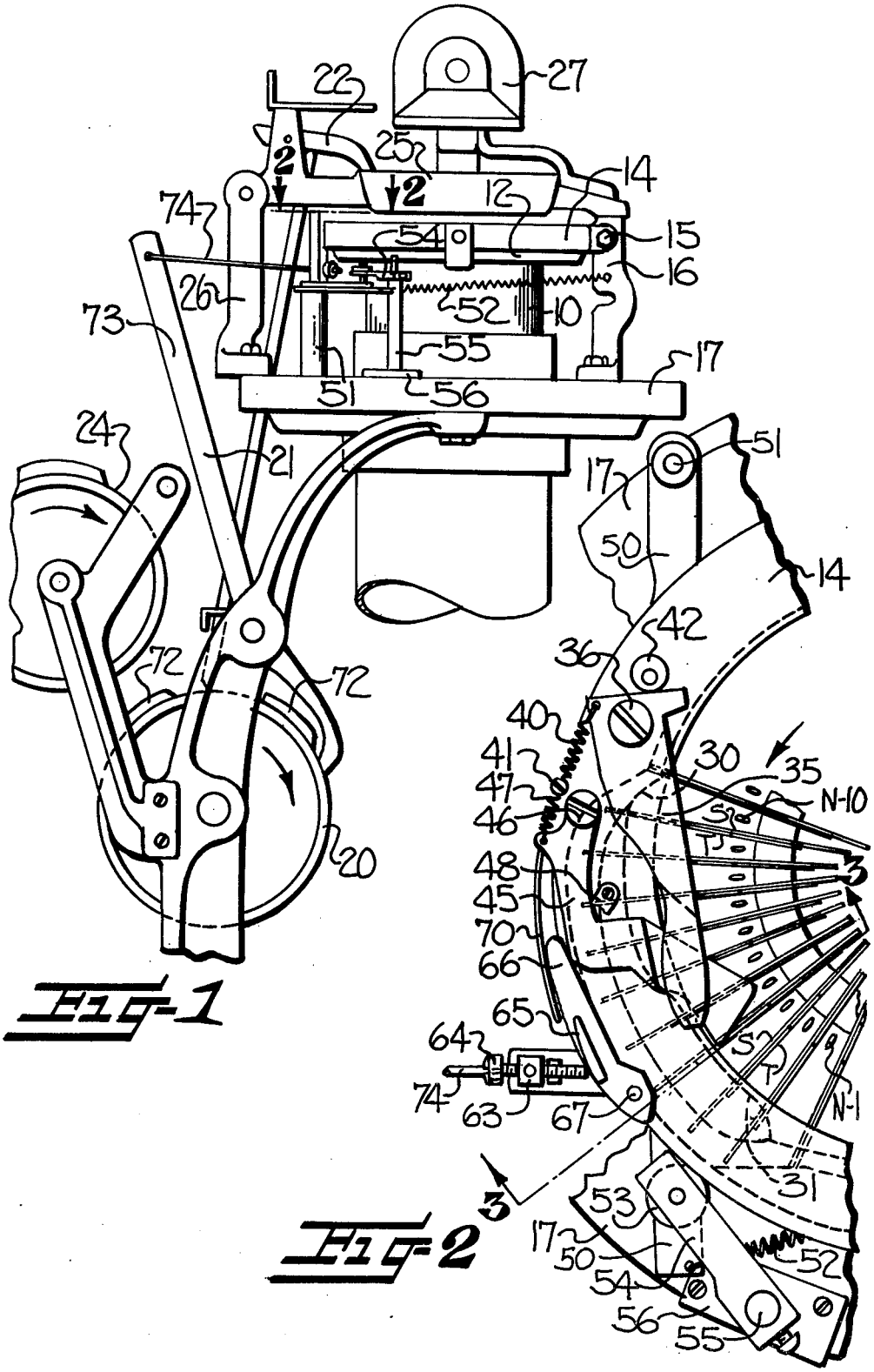
FIG. 1 is a fragmentary elevational view of the upper portion of a circular hosiery knitting machine with the present invention applied thereto.
FIG. 2 is an enlarged fragmentary plan view taken substantially along the line 2—2 in FIG. 1.
Figure 4:
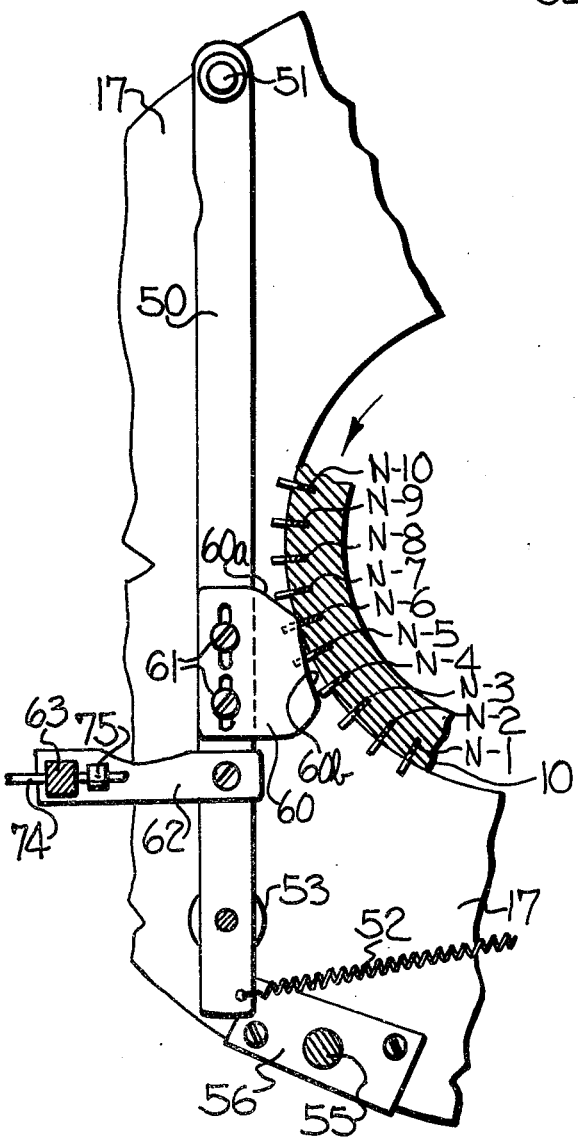
FIG. 4 is a sectional plan view taken substantially along the line 4—4 in FIG. 3.

The present invention is illustrated in association with a conventional circular hosiery knitting machine which includes a needle cylinder 10 with needles, illustrated at N-1 through N-10 in FIGS. 2 and 4, supported for vertical sliding movement in the usual grooves in the needle cylinder and including operating butts on the lower ends thereof. This type of knitting machine is adapted to knit heels and toes by reciprocation with narrowing and widening of an active group of needles while maintaining stitch loops on an inactive group of needles.

Figure 3:
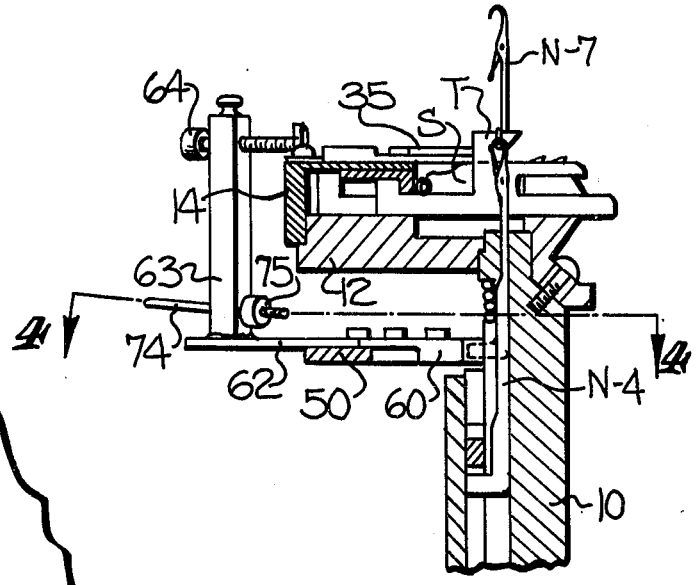
FIG. 3 is a vertical sectional view taken substantially along the line 3—3 in FIG. 2.

A sinker bed 12 (FIG. 3) is supported on the needle cylinder 10 and contains radial grooves with a series of regular sinkers S supported in the grooves for radial movement between the needles and a series of terry sinkers T supported in the grooves with the series of regular sinkers S. The regular sinker S illustrated in FIG. 3 is of the saw-tooth type and is positioned in the same groove with the terry sinker T. If desired, the regular sinker S of the saw-tooth type may be alternated with plain regular sinkers in adjacent grooves, which are also paired with a terry sinker T. A sinker cap 14 is supported on the sinker bed 12 in the usual manner and is prevented from rotation by adjustment bunter screws 15 (FIG. 1) adapted to engage opposite sides of a widening pick support post 16, fixed at its lower end on a bed plate 17.

The machine is also provided with the usual pattern drums, including a main pattern drum 20 provided with suitable cams for operating thrust rods 21 to control the position of yarn feed fingers 22. Another pattern drum 24, usually referred to as a striper drum is also provided with suitable cams for controlling other machine operations.

The yarn feed fingers 20 are supported in the usual yarn feed throat of a latch ring 25 (FIG. 1) which is supported at its forward end on the upper end of the widening pick post 16 and at its rear end on the upper end of a pivot stand 26, the lower end of which is fixed on the bed plate 17. Suitable gearing is supported in a housing 27 for driving the usual dial needles, not shown, which are used in forming rib knitting, such as is usually provided in the cuff portion of a sock.

The sinker cap 14 is provided with the usual sinker control cams for engagement by the butts to control the radial position of the regular sinkers S. The sinker cams include a conventional type sinker withdrawal cam 30, shown in dotted lines in FIG. 2. However, this sinker withdrawal cam 30 has the lower portion cut away, as indicated at 31, so that the butts of the terry sinkers T may be moved inwardly, as shown in FIG. 3, and the terry sinkers may be inserted earlier than normal by the terry sinker control of the prevent invention.

The terry sinker control of the present invention includes an auxiliary terry sinker control cam 35 which is pivotally supported at one end on the sinker cap 14, as by a shoulder screw 36 (FIG. 2). The other end of the auxiliary terry sinker control cam 35 includes an inner cam surface for engaging the upstanding nebs of the terry sinkers T, as illustrated in FIG. 3, and the inner cam surface is undercut, for purposes to be presently described.

Resilient means, in the form of a tension spring 40, is connected at one end to the auxiliary terry sinker control cam 35 and at its other end to a screw 41, fixed in the sinker cap 14. The spring 40 normally urges the inner cam surface of the auxiliary terry sinker control cam 35 inwardly to initally move the terry sinkers T inwardly to a partially advanced position between the needles as the needles approach the yarn feeding position. Adjustble stop means, in the form of an eccentric disc 42 is fixed on the sinker cap 14 for engaging the auxiliary terry sinker control cam 35 and limiting the inward movement of the inner cam surface.

A main terry sinker control cam 45 is pivotally supported at one end on the sinker cap 14, as by a shoulder screw 46 (FIG. 2). A light tension spring 47 is connected at one end to the main terry sinker control cam 45 and at its other end to the screw 41 (FIG. 2). Adjustable stop means, illustrated as an offset stop plate 48, is supported on the sinker cap 14 and limits inward movement of the cam 45. The main terry sinker control cam 45 is provided with a cam surface on the other end which is cut away on its upper surface so that the undercut inner cam surface of the auxiliary terry sinker control cam 35 is slideably supported thereon. The main terry sinker control cam 45 is movable to an inner operative position for engaging the upstanding nebs of the terry sinkers T, as illustrated in FIG. 2, to insert the terry sinkers earlier than normal to form terry loops by drawing the terry yarn over the upper nebs, as illustrated in FIG. 3. The main terry sinker control cam 45 is also movable to an outer inoperative position so that the terry sinkers T are not inserted earlier than normal and the terry yarn is not drawn over the nebs of the sinkers and terry loops are not formed.

First control means is provided for the main terry sinker control cam 45 and is operated by the butts of the inactive needles. This first control means includes a horizontally disposed control lever 50 (FIG. 4) which is pivotally supported at one end on the upper end of a post 51 fixed at its lower end on the bed plate 17. The control lever 50 extends below the sinker bed 12 and is substantially aligned with the butts of the inactive group of needles (FIG. 3). The free end of the control lever 50 extends outwardly beyond the needle cylinder 10 and resilient means, in the form of a tension spring 52, is connected at one end to the control lever 50 and at its other end to the widening pick post 16 (FIG. 1) to normally urge the control lever 50 inwardly toward the needle cylinder 10.

A leveling pad 53 is supported in sliding engagement with the upper surface of the control lever 50 and the pad 53 is threadably supported for vertical adjustment in one end of a support arm 54 (FIG. 2). The other end of the support arm 54 is adjustably supported on the upper end of a support post 55, the lower end of which is fixed on a plate 56 secured to the bed plate 17.

A needle butt cam 60 is supported for longitudinal adjustment by screws 61 on the medial portion of the control lever 50 and is positioned for engagement by the butts of the inactive group of needles to move the control lever 50 away from the needle cylinder 10 when the needle cylinder oscillates in a counterclockwise direction during the reciprocatory knitting of the heel and toe pockets. The needle butt cam 60 is provided with a steep leading cam surface **60*a* and a shallow trailing cam surface 60*b*. The leading cam surface 60*a* defines an angle of about 45° with a tangent of the needle cylinder 10 while the trailing cam surface 60*b* defines an angle of about 15° with a tangent of the needle cylinder 10**, for purposes to be described.

Linkage means operatively connects the control lever 50 and the main terry sinker control cam 45 so that the main terry sinker control cam 45 is moved to the inner operative position when the needle butt cam 60 is not being engaged by the butts of the inactive group of needles and moves the main terry sinker cam 45 to the outer inoperative position when the needle butt cam 60 is engaged by the butts of the inactive group of needles during each oscillation of the needle cylinder 10 in a counterclockwise direction. The linkage means includes a lever arm 62 fixed at one end on the control lever 50 (FIG. 4) with the other end extending outwardly therefrom and being disposed outside the periphery of the sinker cap 14 (FIG. 3). A vertical control post 63 is fixed at its lower end on the outer end of the lever arm 62 and its upper end extends upwardly above the sinker cap 14.

Adjustable operator linkage is supported in the upper end of the control post 63 and is operatively associated with the main terry sinker control cam 45 for controlling the position thereof. The adjustable operator linkage includes an adjustment screw 64 threadably supported in the upper end of the control post 63 and the inner end of the adjustable screw 64 is adapted to engage an upstanding wing 65 of a cam lever 66. One end of the cam lever 66 is pivotally supported on the sinker cap 14, as by a shoulder screw 67, and the other end engages the main terry sinker control cam 45 (FIG. 2). A leaf spring 70 is attached at one end to the outer surface of the sinker cap 14 and the other end normally urges the cam lever 66 inwardly against the main terry sinker control cam 45.

Second control means is operated by the main drum 20 and is operatively connected to the horizontally disposed control lever 50 for selectively maintaining the main terry sinker control cam 45 in either the inner operative position or the outer inoperative position during selected continuous rotations of the needle cylinder, such as while knitting the cuff, leg and circular knit portions of the foot. The second control means operated by the pattern drum 20 includes suitable cams 72 supported on the pattern drum 20 and adapted to engage the lower end of a control lever 73. One end of a control rod 74 is suitably connected to the upper end of the control lever 73 (FIG. 1) and the inner end of the control rod 74 slideably penetrates the control post 63 and is provided with an operating collar 75 (FIGS. 3 and 4).

Method of Operation

The operation will be described in connection with the knitting of a relatively heavy type of boot sock having terry loops in the leg, heel, toe and foot and a nonterry upper ribbed cuff. The knitting begins with the formation of the usual make-up on the upper selvage edge of the cuff and with the cam 72 being positioned beneath the lower end of the control lever 73 (FIG. 1) so that the horizontally disposed control lever 50 is maintained outwardly and away from the needle cylinder 10. The main terry sinker control cam 45 is in the outer inoperative position while the make-up and the rib knit cuff is formed and terry loops are not formed while the needle cylinder rotates continuously in a counterclockwise direction.

With all of the needles in the lower active position, the leg portion is knit by feeding a main body yarn in a low position and below the nebs of the regular sinkers S and the terry sinkers T while the terry yarn is fed at a high position and the terry sinkers T are advanced at an earlier than normal position so that the terry yarn is drawn down by the needles and over the upper nebs of the terry sinkers T to form terry loops. The main terry sinker control cam 45 is maintained in the inner operative position shown in FIG. 2 because the pattern drum 24 is moved so that the cam 72 is out of engagement with the control lever 73, as shown in FIG. 1. Thus, the spring 52 pulls the horizontally disposed control lever 50 inwardly toward the needle cylinder 10 and the cam lever 66 moves the main terry sinker control cam 45 inwardly against the adjustable stop plate 48. Since all of the needles are in the lower or active position during the knitting of the leg, there are no butts traveling the upper inactive level to engage the needle butt cam 60 and the main terry sinker control cam 40 remains in the inner operative position so that terry loops are formed throughout the knitting of each course.

When a sufficient length of fabric with terry loops has been knit to form the leg portion, the machine switches to reciprocatory knitting and a group of needles are switches, in the usual manner, to an upper inactive level so that the butts pass above the stitch cams and the stitch loops are held on these inactive needles. To knit the heel pocket about half of the needles are usually switched to the upper inactive level with the butts traveling a path indicated by the butt of the needle N-7 in FIG. 3.

During the knitting of the heel pocket, the number of active needles is gradually reduced by means of the usual narrowing picks, not shown, and the needles moved to inactive position are raised so that their butts pass above the level of the stitch cams. With gradual narrowing of the fabric, the stitch loops are maintained on the idled needles and terry loops are formed on the active needles with each oscillation of the needle cylinder in a counterclockwise direction, except that terry loops are not formed on the leading two needles and trailing two needles of each partial narrowed course knit when the needle cylinder is oscillated in a counterclockwise direction.

FIGS. 2 and 3 illustrate the knitting of the trailing end of a partial course in the heel pocket with the needle N-3 being positioned with its butt at the bottom of the stitch cam and the last active needle is the needle N-6 while the first inactive needle is the needle N-7 which is in an upper inactive position with its butt in alignment with the needle butt cam 60. As the butt of the needle N-7 engages the steep leading cam surface **60*a* of the needle butt cam 60, the main terry sinker control cam 45** is immediately moved to the outer inoperative position so that the last terry sinker T to be inserted earlier than normal is the sinker adjacent the needle N-4 and the sinkers between the needles N-5, N-6 and N-6, N-7 are not inserted earlier than normal and terry loops are not formed by the needles N-5 and N-6 at the end of the partial course in the heel pocket.

Terry loops are also not formed on the first two active needles at the leading end of each partial course knit when the needle cylinder is oscillated in the counterclockwise direction. The main terry sinker control cam 45 is held in the outer inoperative position while the shallow trailing cam surface **60*b* of the needle butt cam 60** is riding on the butts of the inactive group of needles and until after the first two active needles have been drawn down by the stitch cam to form plain stitches of both the body and terry yarns. Thus, the insertion of the terry yarns T is delayed at the leading end of each partial course and the terry sinkers T are withdrawn at the trailing end of each partial course so that terry loops are not formed in narrow areas along the suture connecting the narrowed and widened sections of the heel pocket.

Upon completion of the knitting of the heel pocket, the foot portion is then knit with continuous rotation of the needle cylinder and the main terry sinker control cam 45 is maintained in the operative position by the spring 52 to form terry loops with all of the needles as the terry yarn is drawn over the nebs of the terry sinkers T. The toe pocket is then knit in the same manner as the heel pocket by knitting a narrowed section of partial courses joined to a widened section of partial courses. A few rotary courses are then usually knit to form loopers rounds and the toe opening.

The terry sinker control of the present invention operates to control the position of the main terry sinker control cam 45 from the butts of the inactive needles during reciprocatory knitting of heel and toe portions of socks so that no terry loops are formed by a few needles at the leading and trailing ends of each partial course of the narrowed and widened sections of the heel and toe pockets. During rotary knitting, the formation of terry loops is controlled by the pattern drum 20 and the associated linkage to position the main terry sinker control cam 45 in either the operative or inoperative position.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a circular hosiery knitting machine adapted to knit heels and toes by reciprocation with narrowing and widening of an active needle group while maintaining stitch loops on an inactive group of needles, said machine including a needle cylinder, needles supported for vertical sliding movement in said needle cylinder and including butts on the lower ends thereof, a sinker bed supported on said needle cylinder and containing radial grooves therein, a sinker cap supported on said sinker bed, a series of regular sinkers supported in said grooves for radial movement between said needles, a series of terry sinkers supported in said grooves with said series of regular sinkers, said terry sinkers including upstanding nebs extending above the level of said sinker cap and being adapted to form terry loops when inserted earlier than normal, and a pattern drum rotatable in timed relationship to operation of said knitting machine, the combination therewith of (a) an auxiliary terry sinker control cam pivotally supported at one end on said sinker cap and including a cam surface on the other end for engaging the upstanding nebs of said terry sinkers, (b) resilient means normally urging said cam surface of said auxiliary terry sinker control cam inwardly to initially move said terry sinkers inwardly to a partially advanced position between said needles, (c) adjustable stop means supported on said sinker cap for engaging and limiting the inward movement of said cam surface of said auxiliary terry sinker control cam, (d) a main terry sinker control cam pivotally supported at one end on said sinker cap and including a cam surface on the other end movable between an inner operative position for engaging the upstanding nebs of said terry sinkers to insert the same earlier than normal to form terry loops, and an outer inoperative position so that said terry sinkers are not inserted earlier than normal, (e) a horizontally disposed control lever pivotally supported at one end and extending below said sinker bed and substantially aligned with the butts of the inactive group of needles, (f) resilient means normally urging said control lever inwardly toward said needle cylinder, (g) a needle butt cam supported for longitudinal adjustment on said control lever for engagement by the butts of the inactive group of needles to move said control lever away from said needle cylinder, said needle butt cam including a steep leading cam surface and a shallow trailing cam surface, and (h) linkage means operatively connecting said control lever and said main terry sinker control cam for moving said main terry sinker control cam to the inner operative position when said needle butt cam is not being engaged by the butts of the inactive group of needles and for moving said main terry sinker cam to the outer inoperative position when said needle butt cam is engaged by the butts of the inactive group of needles during each oscillation of said needle cylinder in a counterclockwise direction.

2. In a circular hosiery knitting machine according to claim 1 wherein said steep leading cam surface of said needle butt cam defines an angle of about 45° with a tangent of said needle cylinder, and wherein said shallow trailing cam surface of said needle butt cam defines an angle of about 15° with a tangent of said needle cylinder.

3. In a circular hosiery knitting machine according to claim 1 including (i) control means operated by said pattern drum and operatively connected to said horizontally disposed control lever for selectively maintaining said main terry sinker control cam in either said inner operative position or said outer inoperative position during selected continuous rotations of said needle cylinder, said control means also being operable to permit positioning of said main terry sinker control cam by engagement of the butts of the inactive group of needles with said needle butt cam during each oscillation of said needle cylinder in a counterclockwise direction.

4. In a circular hosiery knitting machine according to claim 1 wherein said cam surface on said other end of said auxiliary terry sinker control cam is positioned for sliding movement on and overlying said cam surface on said other end of said main terry sinker control cam.

5. In a circular hosiery knitting machine according to claim 1 including (j) adjustable stop means supported on said sinker cap for engaging and limiting the inward movement of said cam surface of said main terry sinker control cam.

6. In a circular hosiery knitting machine according to claim 3 wherein said linkage means (h) includes (1) a lever arm fixed at one end on said control lever and extending outwardly thereof with the other end being disposed outside the periphery of said sinker cap, (2) a vertical control post having its lower end fixed on said lever arm and its upper end extending upwardly above said sinker cap, and (3) adjustable operator linkage supported in the upper end of said control post and being operatively associated with said main terry sinker control cam for controlling the position thereof.

7. In a circular hosiery knitting machine according to claim 6 wherein said control means (i) includes (1) cam means supported on said pattern drum, (2) a control lever operated by said cam means on said pattern drum, and (3) a control link operatively linking said control lever and said control post.

* * * * *